US005333790A

United States Patent [19]

Christopher

[11] Patent Number: 5,333,790

[45] Date of Patent: * Aug. 2, 1994

[54] QUICK DISCONNECT NOZZLE APPARATUS

[76] Inventor: Gilman O. Christopher, 924 W. 11th Pl., Mesa, Ariz. 85201

[ * ] Notice: The portion of the term of this patent subsequent to Aug. 2, 2010 has been disclaimed.

[21] Appl. No.: 871,101

[22] Filed: Apr. 20, 1992

[51] Int. Cl.[5] ..... B05B 15/06

[52] U.S. Cl. ..... 239/391; 239/600; 239/DIG. 23

[58] Field of Search ..... 239/171, 390, 391, 600; 285/12, 16, 906

[56] References Cited

U.S. PATENT DOCUMENTS

| | | | |
|---|---|---|---|
| 2,017,362 | 10/1935 | Werder | 285/906 X |
| 2,242,680 | 5/1941 | Schacht | 239/DIG. 23 |
| 4,185,781 | 1/1980 | O'Brien | 239/600 |
| 4,438,884 | 3/1984 | O'Brien et al. | 239/600 |
| 4,738,401 | 4/1988 | Filicicchia | 239/600 |
| 4,878,548 | 11/1989 | Ostertag et al. | 239/600 X |
| 4,899,937 | 2/1990 | Haruch | 239/600 X |
| 4,919,334 | 4/1990 | Hartmann et al. | 239/600 |

*Primary Examiner*—Andres Kashnikow
*Assistant Examiner*—William Grant
*Attorney, Agent, or Firm*—H. Gordon Shields

[57] ABSTRACT

Quick release nozzle apparatus includes a fixed nozzle housing and a removable nozzle assembly which may be secured to and removed from the fixed nozzle base without the use of tools and with just one hand. The nozzle assembly is locked to the fixed base through a spring bias which urges the nozzle assembly against a pair of locking tabs on the fixed nozzle base. Rotation of the nozzle assembly relative to the nozzle base aligns relieved portions with the lock tabs for removal and installation of the nozzle assembly and aligns a shoulder or face portion with the lock tabs for securing the elements together.

12 Claims, 1 Drawing Sheet

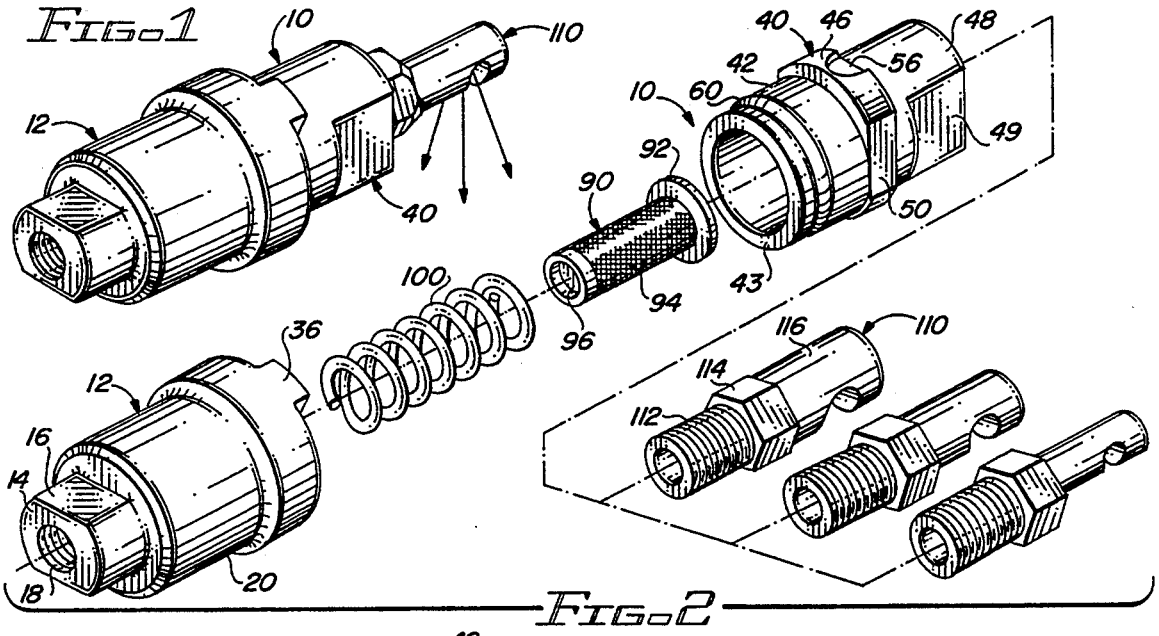
FIG. 2
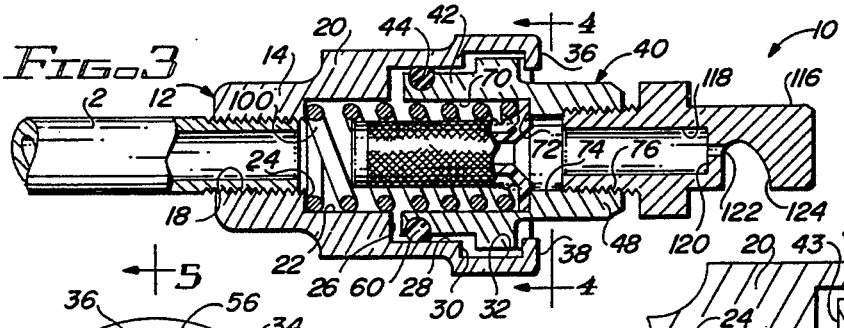
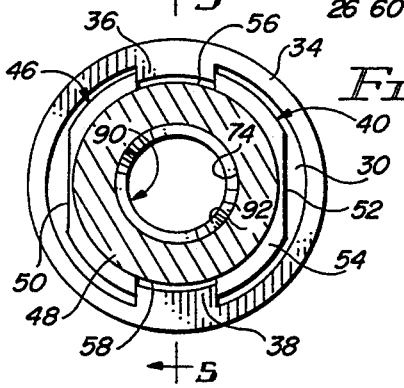
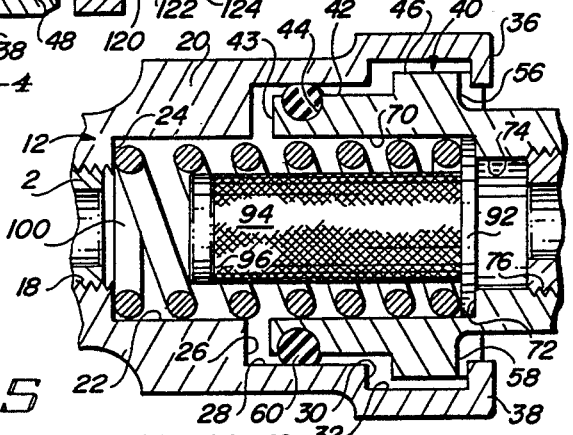
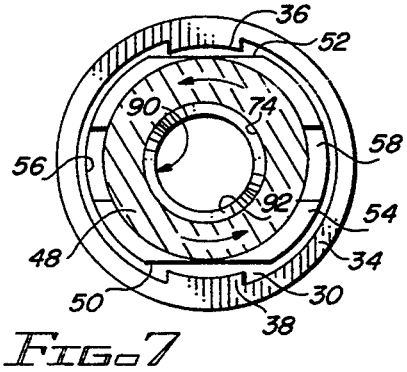
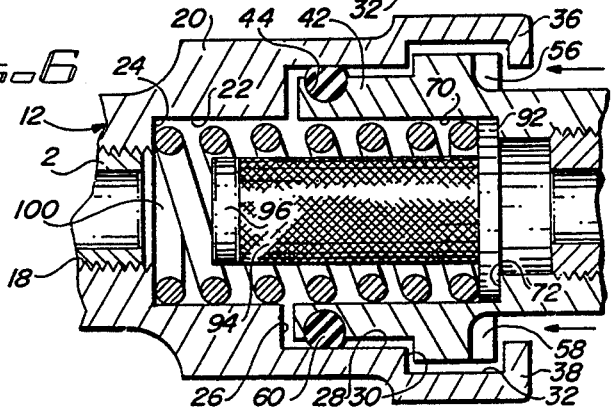

QUICK DISCONNECT NOZZLE APPARATUS

BACKGROUND OF THE INVENTION

1. Field of the Invention

This invention relates to nozzles particularly adapted for aerial spray operations and, more particularly, to a quick disconnect nozzle apparatus which allows any of a plurality of nozzles to be quickly secured to and removed from a fixed nozzle base.

2. Description of the Prior Art

Different types of aerial spray operations require different types of nozzles. Different nozzles have or provide different spray patterns, and it may be desirable to change from one nozzle to another nozzle "in the field" in the course of daily operations. In the prior art, the changing of one nozzle for another nozzle requires the use of tools to accomplish.

With the apparatus of the present invention, a fixed nozzle base is secured to a conduit on an aircraft. A nozzle assembly may be easily secured to and removed from the fixed nozzle base without the use of tools. The nozzle assembly is securely locked in place on the base.

SUMMARY OF THE INVENTION

The invention described and claimed herein comprises a fixed nozzle base secured to a supply conduit and a nozzle assembly in turn is removably secured to the nozzle base. The nozzle base includes a plurality of coaxially aligned bores, with locking tabs extending radially inwardly from the outermost bore. The locking tabs matingly engage locking slots to hold the nozzle assembly to the nozzle base. Axial movement of the nozzle assembly against the bias of a compression spring causes the locking slots to move out of engagement with the locking tabs, and the nozzle assembly may be rotated to align the locking tabs with parallel flats on the nozzle assembly, with the distance between the flats being slightly less than the distance between the locking tabs. This allows the nozzle assembly to be removed from the nozzle base. For removal and installation of the nozzle assembly, sufficient inward pressure or force must be applied to overcome the bias of the compression spring in order to rotate the nozzle assembly.

Among the objects of the present invention are the following:

To provide new and useful nozzle apparatus;

To provide new and useful quick disconnect nozzle apparatus;

To provide new and useful nozzle apparatus which includes a fixed nozzle base and a nozzle assembly secured to the nozzle base;

To provide new and useful nozzle apparatus in which a nozzle assembly may be secured to and removed from a nozzle base by an individual using only one hand;

To provide new and useful nozzle apparatus in which a nozzle assembly is secured to a nozzle base by means of a spring bias which urges a locking slot into engagement with a locking tab; and To provide new and useful nozzle apparatus in which any of a plurality of nozzle assemblies may be easily secured to and removed from a nozzle base without tools.

BRIEF DESCRIPTION OF THE DRAWING

FIG. 1 is a perspective view of the apparatus of the present invention.

FIG. 2 is an exploded perspective view of the apparatus of the present invention.

FIG. 3 is a view in partial section of the apparatus of the present invention.

FIG. 4 is a view in partial section taken generally along line 4—4 of FIG. 3.

FIG. 5 is a view in partial section taken generally along line 5—5 of FIG. 4.

FIG. 6 is a view in partial section of the apparatus of FIG. 5 illustrating the removal operation of a portion of the apparatus of FIG. 5.

FIG. 7 is a view in partial section sequentially following FIG. 6 and further illustrating the removal operation.

DESCRIPTION OF THE PREFERRED EMBODIMENT

FIG. 1 is a perspective view of nozzle apparatus 10 of the present invention. The nozzle apparatus 10 includes a nozzle base 12 which is generally fixed to an aircraft, or the like, in its use environment. Secured to the nozzle base 12 is a nozzle assembly 40. The nozzle assembly 40 is removable from the nozzle base 12 for a quick replacement. A nozzle 110 is in turn secured to the nozzle assembly 40.

FIG. 2 is an exploded perspective view of the nozzle apparatus 10 of FIG. 1, showing the nozzle base 12 spaced apart from the nozzle assembly 40, and showing a plurality of nozzles 110 spaced apart from the nozzle assembly 40. For convenience, there may be a plurality of nozzle assemblies 40, each with a different nozzle 110 secured thereto as a part thereof. As discussed below, the nozzle assemblies 40 may be easily removed from and secured to the base 12 with only one hand of the individual required for the removal and installation process.

FIG. 3 comprises a side view and partial section of the assembled nozzle apparatus 10. For the following general discussion, reference will primarily be made to FIGS. 1, 2, and 3.

The nozzle base 12 comprises a fixed housing which is appropriately secured to a conduit 2. The conduit 2 in turn extends, ultimately, to a supply tank through which fluid may flow for spraying purposes.

The nozzle base or fixed housing 12 includes a connector portion 14 which is connected to the conduit 2. The connector portion 14 includes a pair of generally parallel wrench flats 16 which are used to secured the base or housing 12 to the conduit 2. Extending through the connector portion 14 is an internally threaded bore 18. The internally threaded bore 18 receives the outer externally threaded portion of the conduit 2, as shown in FIG. 3.

The housing 12 also includes a central portion 20 in which there are a plurality of bores. There is an inner bore 22 which communicates with the conduit 2, and the bore 18 and receives fluid from the conduit 2.

The diameter of the bore 22 is substantially larger than that of the bore 18. A shoulder 24 extends between the bores 18 and 22. The shoulder 24 comprises an end wall for the bore 22.

At the "outer" end of the bore 22, remote from bore 18 and the shoulder 24, there is a radially outwardly extending shoulder 26. The shoulder 26 extends to a middle bore 28. The diameter of the middle bore 28 is substantially greater than that of the bore 22.

A radially outwardly extending shoulder 30 extends between the middle bore 28 and an outer bore 32. The diameter of the outer bore 32 is greater than that of the middle bore 28.

There is an outer end or face 34 on the housing portion 20. The end face 34 is best shown in FIGS. 4 and 7. The end face 34 is generally perpendicular to the longitudinal axis of the bore 32, and accordingly also perpendicular to the longitudinal axis of the bores 18, 22, and 28.

Extending radially inwardly from the outer end or face 34 of the outer bore 32 is a pair of locking tabs 36 and 38. The tabs 36 and 38 are aligned with each other. The arcuate width of the locking tabs 36 and 38 cooperates locking slots on the nozzle assembly 40, as will be explained below.

The nozzle assembly 40 comprises a connector element which allows any of the nozzles 110 to be secured to the nozzle base 12. The nozzle assembly 40 includes a cylindrical portion 42 which extends into the bore 28. The cylindrical portion 42 extends to a rear face 43. In the use environment, the face 43 is disposed within the bore 28.

On the exterior periphery of the cylindrical portion 42, adjacent to the face 43, there is a circumferentially extending groove 44. An o-ring 60 is disposed in the groove 44.

The nozzle assembly 40 includes a lock portion 46 adjacent to the cylindrical portion 42 and a front portion 48 to which a nozzle 110 is secured. The lock portion 46 includes a pair of flats 50 and 52 which are generally parallel to each other. The distance between or across the flats 50 and 52 is less than the distance between the locking tabs 36 and 38, and accordingly allow the nozzle assembly 40 to be secured to and removed from the nozzle base or fixed housing 12. The flats 50 and 52 comprise relieved portions essentially cut away from what would be an enlarged cylindrical area which the lock portion 46 would comprise were it not for the flats.

FIGS. 4, 5, 6, and 7 illustrate details of the securing elements of the nozzle assembly 40 and the base 12 and how the two portions are separated or disassembled. FIG. 4 is an enlarged view in partial section of a portion of the apparatus of the present invention, taken generally along line 4—4 of FIG. 3. FIG. 5 is a view in partial section taken generally along line 5—5 of FIG. 4. FIG. 6 is a view in partial section sequentially following FIG. 5 in the removal or disassembly procedure of the nozzle assembly 40 from the nozzle base 12. FIG. 7 is a view in partial section sequentially following FIG. 6, but corresponding to FIG. 4 to illustrate the alignment of the locking tabs 36 and 38 with the flats 50 and 52 for the removal of the nozzle assembly 40.

As shown in FIG. 7, when the flats 50 and 52 are aligned with the locking tabs 36 and 38, the nozzle assembly 40 may be moved longitudinally relative to the nozzle base 12 for installing and removal purposes. This will be discussed below.

The maximum diameter of the lock portion 46 is greater than the distance between the locking tabs 36 and 38. However when the flats 50 and 52 are disposed adjacent to the locking tabs 36 and 38, the lock portion 46 and the cylindrical portion 42 may be inserted or extended into the nozzle base 12, with the cylindrical portion 42 disposed within the bore 28 and the lock portion 46 disposed within the bore 32.

The nozzle assembly 40 also includes a front portion 48 which extends outwardly from the lock portion 46. The front portion 48 includes a pair of generally parallel wrench flats 49 which are used in conjunction with the securing of a nozzle 110 to the front portion 48.

Between the front portion 48 and the lock portion 46 is a front shoulder or face 54. The front face 54 extends radially inwardly from the lock portion 46 to the front portion 50. The shoulder or face 54 has a diameter or overall width which is greater than the distance between the locking tabs 36 and 38. A pair of locking slots 56 and 58 extend axially rearwardly in the locking portion 46 from the front face 54. The locking slots 56 and 58 are semicircular in configuration and they extend arcuately in the locking portion.

The locking tabs 36 and 38 are generally rectangular in configuration and they also extend arcuately. The rectangular locking tabs extend into the rounded or circular portion of the locking slots to secure the nozzle assembly 40 to the base 12. The rectangular/circular engagement prevents relative rotation of the two elements in their locked configuration.

The locked configuration or engagement is shown in both FIGS. 4 and 5.

Details of the removal of the nozzle assembly 40 from the nozzle base 12 are illustrated particularly in FIGS. 6 and 7, but reference will also be made to FIGS. 4 and 5, and to FIGS. 2 and 3 for further explanation of the structure and functioning of the apparatus 10.

FIGS. 6 and 7 sequentially follow FIGS. 4 and 5 in illustrating the removal and/or insertion of a new nozzle assembly 40 to the nozzle base 12. FIG. 6 is a view in partial section corresponding to and sequentially following FIG. 5, while FIG. 7 is a view in partial section sequentially following FIG. 6 and illustrating the rotation of the nozzle assembly 40 relative to the base 12.

Within the nozzle assembly 40, and primarily within the cylindrical portion 42 and the lock portion 46, is a spring bore 70. A shoulder 72 extends from the spring bore 70 to an exit bore 74. The diameter of the exit bore 74 is substantially less than that of the spring bore 70. The exit bore 72 includes a tapped portion 76 which receives a portion of a nozzle 110.

A screen sleeve 90 is disposed within the bore 70 and against the shoulder 72. The sleeve 90 includes a base 92 and a screen 94. A cap or plug 96 closes the end of the screen 94 remote from the base 92. The base 92 is disposed against the shoulder 72, and the screen 94 extends longitudinally within the bore 70 and into the bore 22 of the nozzle base 12.

The compression spring 100 is disposed within the spring bore 70 between the base 92 of the sleeve 90 and against the shoulder 24 of the nozzle base 12 and within the bore 22. The diameter of the bores 22 and 70 are substantially the same, and the bores are generally aligned, as shown in FIGS. 3, 5, and 6.

The compression spring 100 provides a bias to urge the nozzle assembly 40 out of the housing or nozzle base 12. However, when locking slots 56 and 58 are aligned with the locking tabs 36 and 38, the spring 100 serves to lock the nozzle assembly 40 to the nozzle base 12. As shown in FIGS. 5 and 6, the o-ring 60 in the o-ring groove 44 is in a sealing engagement with the bore 28. Accordingly, fluid flows from the input conduit 2 into the bore 22 and through the aligned bores 22 and 70, and through the screen 94 into the bore 74 and outwardly from the bore 74 through a nozzle 110 for spray purposes.

The spring 100 biases the base 92 of the sleeve 90 against the shoulder 72 to seal the sleeve to the shoulder 72. All of the fluid flowing through the conduit 2 and into the base 20 must accordingly flow through the screen 94 to exit through the bore 74 and the nozzle 110.

In FIG. 4, the nozzle assembly 40 is shown secured to the nozzle base 12. The locking slots 56 and 58 of the lock portion 46 engage the locking tabs 36 and 38. The bias of the spring 100 holds the two portions, the base 12 and the nozzle assembly 40, together. This is shown in both FIGS. 3 and 4.

When a positive inward movement of the nozzle assembly 40 relative to the base 12 overcomes the bias of the spring 100, the spring is compressed, as shown in FIG. 6. The nozzle assembly 40 may then be rotated until the flats 50 and 52 are aligned with the locking tabs 36 and 38, as shown in FIG. 7. The nozzle assembly 40 may then be moved longitudinally to remove the nozzle assembly for a quick disconnect and a quick replacement of another nozzle assembly.

It will be noted that a counterclockwise rotation is illustrated in FIG. 7 by relatively large arrows. The rotation of the nozzle assembly 40 may be clockwise, if desired. Since the apparatus is substantially symmetrical, the direction of rotation of the nozzle assembly 40 is immaterial.

Details of the nozzle 110 are best illustrated in FIG. 3, and reference will primarily be made to FIG. 3.

The nozzle 110 includes an externally threaded portion 112 which matingly engages the internally threaded bore or tapped portion 76 of the exit bore 74. Adjacent to the externally threaded portion 112 is a hexagonal body portion 114. The hexagonally configured body portion defines a plurality of, or actually six, wrench flats for securing the nozzle 110 to the front portion 50 of the nozzle assembly 40. Rearwardly of the hexagonal body portion 114 is a spray head 116.

A bore 118 extends through the externally threaded portion 112 and the hexagonal body portion 114. The bore 118 terminates in the spray head 116 in an end wall 120.

Extending through the end wall 120 is an orifice 122. Spaced apart from the orifice 122 is a spray wall or surface 124. The surface 124 extends through the spray head 116. The surface 124 may be curved as desired to provide a particular spray pattern.

Fluid flowing from the conduit 2 through the nozzle base 12 and the nozzle assembly 40 flows through the nozzle 110 and in the bore 118 and through the orifice 122 to impinge on the spray wall or surface 124. The configuration of the spray wall or surface 124 determines the spray pattern of the fluid. The spray wall or surface 124 comprises a curved wall, or the rear wall, of a notch extending upwardly into the spray head 116.

In FIG. 2, three different nozzles are illustrated. It will be noted that each of the nozzles includes a differently configured spray wall, and each nozzle will accordingly provide a different spray pattern. With a different nozzle secured to a nozzle assembly, it will be understood that a quick change may be made in the field, as it were, to adapt the apparatus 10 to the particular spray pattern desired by simply removing a particular nozzle assembly and installing a desired nozzle assembly having a nozzle for providing the desired spray pattern.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Quick disconnect nozzle apparatus comprising, in combination:

base housing means connected to a flow of fluid, including bore means through which the fluid flows;

nozzle assembly means secured to the base housing means, including, a first portion extending into the bore means of the base housing means, a spring bore communicating with the bore means of the base housing means for receiving fluid from the base housing means, and an exit bore communicating with the spring bore for receiving fluid from the spring bore;

a nozzle connected to the nozzle assembly means for receiving the flow of fluid from the exit bore; and means for removably securing the nozzle assembly means to the base housing means, including, lock tab means including a generally rectangular locking tab on the base housing means, a front face portion on the first portion of the nozzle assembly means movable adjacent to the lock tab means for securing the nozzle assembly means to the base housing means, and movable away from the lock tab means to disconnect the nozzle assembly means from the base housing means, and a semi-circular locking slot extending axially rearwardly from the front face for receiving the lock tab means, wherein the rectangular/circular engagement prevents relative rotation of the locking tab and the locking slot in their locked configuration.

2. The apparatus of claim 1 in which the bore means of the base housing means further includes an end wall, and the nozzle assembly means further includes a shoulder between the spring bore and the exit bore, and the means for removably securing the nozzle assembly means to the base housing means further includes a compression spring disposed in the bore means of the base housing means and extending into the spring bore of the nozzle assembly means for biasing the circular slot of the front face portion of the nozzle assembly means against the lock tab means of the base housing means.

3. The apparatus of claim 2 in which the compression spring extends between the end wall of the bore means of the base housing means and the shoulder between the spring bore and the exit bore of the nozzle assembly means.

4. The apparatus of claim 1 in which the bore means of the base housing means includes an inner bore for receiving the flow of fluid, a middle bore into which the first portion of the nozzle assembly extends, and an outer bore in which the front face of the nozzle assembly means is disposed.

5. The apparatus of claim 4 in which the first portion of the nozzle assembly means includes a cylindrical portion extending into the middle bore of the bore means of the base housing means, means for sealing the cylindrical portion and the middle bore, and a lock portion disposed in the outer bore, and the front face portion is on the lock portion.

6. The apparatus of claim 5 in which the first portion of the nozzle assembly means further includes flats on the lock portion adjacent to the front face portion, and the nozzle assembly means is rotatable relative to the base housing means to align the flats with the lock tab means to disconnect the nozzle housing means from the base housing means.

7. The apparatus of claim 1 in which the nozzle assembly means further includes screen means disposed in the spring bore for filtering the fluid flowing from the base housing means to the exit bore and the nozzle.

8. The apparatus of claim 7 in which the nozzle assembly means further includes means for securing the screen means in the spring bore.

9. The apparatus of claim 8 in which the means for securing the screen means in the spring bore comprises a compression spring disposed in the bore means of the base housing means and in the spring bore of the nozzle assembly means.

10. The apparatus of claim 8 in which the means for securing the screen means in the spring bore comprises a compression spring, and the compression spring also biases the lock tab means in the circular recess.

11. The apparatus of claim 1 in which the nozzle assembly means further includes a shoulder between the spring bore and the exit bore.

12. The apparatus of claim 11 in which the nozzle assembly means further includes screen means disposed in the spring bore, including a base disposed on the shoulder between the spring bore and the exit bore, and a generally cylindrical screen secured to the base and extending into the spring bore for filtering the fluid flow in the spring bore.

* * * * *